US006828896B2

(12) United States Patent
Ohashi et al.

(10) Patent No.: US 6,828,896 B2
(45) Date of Patent: Dec. 7, 2004

(54) FUSE

(75) Inventors: Norihiro Ohashi, Haibara-gun (JP); Mitsuhiko Totsuka, Haibara-gun (JP); Takuro Yamashita, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/448,105

(22) Filed: May 30, 2003

(65) Prior Publication Data

US 2003/0222752 A1 Dec. 4, 2003

(30) Foreign Application Priority Data

May 31, 2002 (JP) ..... P2002-160011

(51) Int. Cl.[7] ..... H01H 85/175; H01H 85/165
(52) U.S. Cl. ..... 337/205; 337/186; 337/194
(58) Field of Search ..... 337/186, 187, 337/205, 222, 227, 228, 246, 262, 263, 194, 198

(56) References Cited

U.S. PATENT DOCUMENTS 2,206,786 A * 7/1940 Linton ..... 337/266
3,699,500 A * 10/1972 Borzoni et al. ..... 439/357
4,563,666 A * 1/1986 Borzoni ..... 337/252
4,608,548 A * 8/1986 Borzoni ..... 337/201
4,672,352 A * 6/1987 Takano ..... 337/264
4,800,358 A * 1/1989 Takenouchi et al. ..... 337/268
4,830,631 A * 5/1989 Hsueh ..... 439/622
5,444,428 A * 8/1995 Carr et al. ..... 337/188
5,883,561 A * 3/1999 Nakamura et al. ..... 337/198
5,886,612 A * 3/1999 Beckert et al. ..... 337/197
5,929,740 A * 7/1999 Oh et al. ..... 337/198
6,067,004 A * 5/2000 Hibayashi et al. ..... 337/227
6,275,135 B1 * 8/2001 Hibayashi et al. ..... 337/227
6,448,882 B1 * 9/2002 Inaba et al. ..... 337/227
6,457,995 B1 * 10/2002 Brooks ..... 439/621
6,486,766 B1 * 11/2002 Reid et al. ..... 337/186

FOREIGN PATENT DOCUMENTS

JP 11-96890 A 4/1999
JP 11-96891 A 4/1999

* cited by examiner

*Primary Examiner*—Anatoly Vortman
(74) *Attorney, Agent, or Firm*—Sughrue Mion, PLLC

(57) ABSTRACT

A housing body contains the fuse body therein. The fuse body is formed with an opening and a retaining projection arranged in the vicinity of the opening. A cover body is formed with a locking piece adapted to engage with the retaining projection so that the cover body closes the opening. A rigidity-reduced portion is formed in the cover body, so that the cover body can be flexed substantially without flexing the locking piece, at least when the locking piece engages with the retaining projection.

4 Claims, 7 Drawing Sheets

FUSE

BACKGROUND OF THE INVENTION

This invention relates to a fuse used for protecting an automotive electric circuit or the like, and more particularly to an improved fuse in which a fuse body is housed and held in a housing provided with a cover.

FIGS. 6 and 7 show a related-art fuse used for protecting an electric circuit in an automobile or the like.

A fusible link 1 is a so-called plug-in type fuse, and comprises a fuse body 2 made of a metal sheet, a housing 3 which is made of an insulative resin, and has the fuse body 2 housed and held therein (the fuse body 2 is inserted into the housing 3 through a rectangular upper opening), and a cover 4 which is made of an insulative resin, and covers the upper opening in the housing 3.

As shown in FIG. 7, the fuse body 2 includes a strip-like fusible conductor 10 having a melting portion 10*a*, and a pair of female terminals 11 and 11 which are formed respectively at both ends of the fusible conductor 10, and can be fittingly connected respectively to mating tab terminals 15 formed on a circuit provided at a fuse receiving portion 13. This fuse body 2 is formed into an integral construction, using a metal sheet.

The cover 4 includes a lid 5 in the form of a generally rectangular plate, and a pair of locking pieces 6 extending downwardly respectively from opposite end edges of the lid 5, and this cover 4 is molded into an integral construction, using a transparent plastic material. Retaining projections 7 are formed on and project respectively from those side walls (peripheral wall) of the housing 3 corresponding respectively to the locking pieces 6. When the pair of elastic locking pieces 6 are retainingly engaged with the retaining projections 7, respectively, the cover 4 is locked to the housing 3 in such a manner that this cover 4 covers the upper opening in the housing 3.

As shown in FIG. 7, the fusible link 1 is mounted in the fuse receiving portion 13 formed at an electric connection box such as a relay box, and the fuse body 2 is electrically connected to the mating tab terminals 15. A fuse guide wall 14 for supporting the housing 3 is formed at the fuse receiving portion 13, and this fuse guide wall 14 serves to guide the mounting insertion of the fusible link 1, and also serves to prevent the fusible link 1 from being displaced out of position after the fusible link 1 is mounted.

In recent years, electric connection boxes have increasingly been required to have a compact and lightweight design and a reduced cost, and in this connection fuses also have been required to have a compact and lightweight design.

Therefore, for example, when a fuse body 22 as well as a housing 23 has a compact design (a reduced height) as in a fusible link 21 shown in FIG. 8, this fusible link 21 can be much more reduced in size and weight as compared with the fusible link 1 shown in FIG. 7.

And besides, since the fusible link 21 has the compact design and the reduced height, a cover of an electric connection box can be reduced in height, so that the compact and lightweight design of the electric connection box is also achieved.

In the fuse body 22, secondary (subsequent) short-circuit or the like must be prevented when a fusible conductor 28 melts, and therefore it is difficult to further reduce the distance between a pair of female terminals 29.

Therefore, horizontal dimensions and shapes of the fuse body 22 and housing 23 are substantially the same as those of the fuse body 2 and housing 3 of the fusible link 1, and a cover 24 has the same shape as that of the cover 4, and the cover 24 is locked to the housing 23 by locking pieces 26 retainingly engaged respectively with retaining projections 27 formed on and projecting from a peripheral wall of the housing 23.

However, when the fusible link 21 is to be mounted in the fuse receiving portion 13 formed at the electric connection box such as a relay box, as shown in FIG. 8, the locking pieces 26 interfere with an upper edge of the fuse guide wall 14, so that this fusible link 21 can not be mounted in the proper position in the fuse receiving portion 13.

Therefore, it is necessary to take countermeasures such as the reduction of the height of the fuse guide wall 14 and the formation of notches for preventing the interference. However, such countermeasures for the fuse guide wall 14 will incur a change of a mold for molding an electric connection box body and a complicated construction of the mold, so that the cost greatly increases.

When the locking pieces 26 of the cover 24 are shortened so as to prevent the interference thereof with the upper edge of the fuse guide wall 14, each locking piece 26 is less elastically deformed when it slides over the retaining projection 27. Incidentally, when each retaining projection 27 is reduced in height so that the locking piece 26 can easily slide over the retaining projection 27, a sufficient retaining force can not be obtained, and the cover 24 can be easily disengaged from the housing.

When the locking pieces 26 are shortened, and therefore are less elastically deformed, there are anxieties that the cover 24 can not be easily fitted on the housing, and that each locking piece 26 is damaged at its proximal end portion on which an excessive force acts.

SUMMARY OF THE INVENTION

It is therefore an object of this invention to provide a fuse having a compact and lightweight design while being provided with a cover having locking pieces which are prevented from damage.

In order to achieve the above object, according to the invention, there is provided a fuse, comprising:

- a fuse body, provided with a fusible element;
- a housing body, containing the fuse body therein, and formed with an opening and a retaining projection arranged in the vicinity of the opening; and
- a cover body, formed with a locking piece adapted to engage with the retaining projection so that the cover body closes the opening,
- wherein a rigidity-reduced portion is formed in the cover body, so that the cover body can be flexed substantially without flexing the locking piece, at least when the locking piece engages with the retaining projection.

In such a configuration, even when the locking piece is short, the cover body itself is elastically deformed at the rigidity-reduced portion so that the locking piece can be displaced in the disengaging directions respectively relative to the retaining projection.

Since an excessive force will not act on the locking piece which is displaced so as to slide over the corresponding retaining projection, damage to the locking pieces is prevented.

Therefore, there can be obtained the compact and lightweight fuse provided with the cover body having the relatively short locking piece.

Preferably, the rigidity-reduced portion is a recessed portion formed in a face of the cover body to be opposed to the opening.

In such a configuration, merely by forming the recessed portion in the cover body, the rigidity-reduced portion which enables the elastic deformation of the cover body can be easily formed. Further, by suitably determining the width and depth of the recessed portion, the retaining force of the locking piece can be arbitrarily adjusted.

Preferably, the locking piece includes a pair of locking pieces, which are arranged symmetrically with respect to the rigidity-reduced portion.

Preferably, the fusible element is exposed through the opening, in a case where the cover body does not close the opening.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the present invention will now be described in detail with reference to the accompanying drawings.

Figure 1:
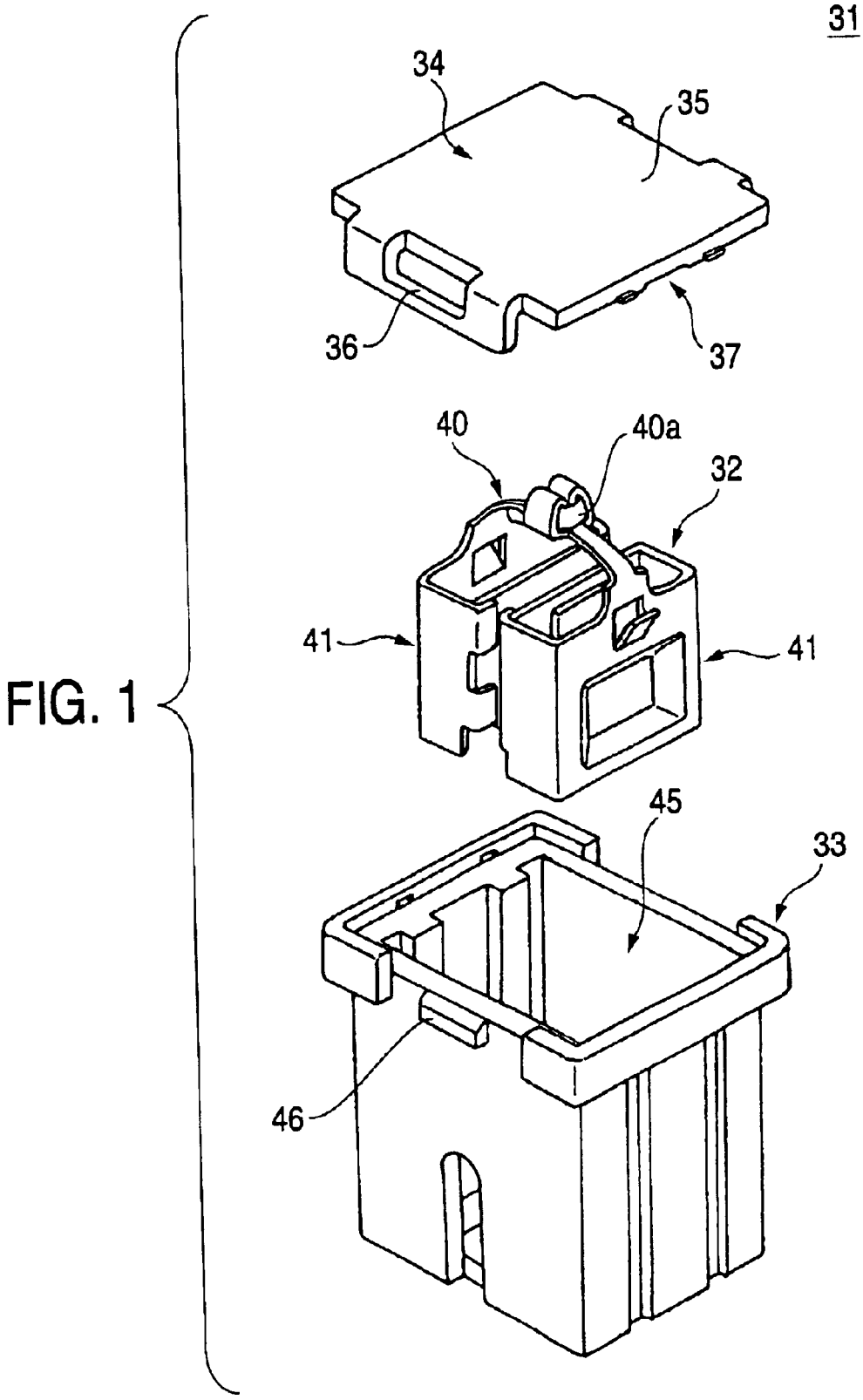
FIG. 1 is an exploded, perspective view of a fuse according to a first embodiment of the present invention.

As shown in FIG. 1, a fusible link 31 according to a first embodiment is a so-called plug-in type fuse, and comprises a fuse body 32 made of a metal sheet, the housing 33 which is made of an insulative resin, and has the fuse body 32 housed and held therein (the fuse body 32 is inserted into the housing 33 through a rectangular upper opening 45), and the cover 34 which is made of an insulative resin, and covers the upper opening 45 in the housing 33.

As shown in FIG. 1, the fuse body 32 includes a strip-like fusible conductor 40 having a melting portion 40*a*, and a pair of female terminals 41 which are formed respectively at both ends of the fusible conductor 40, and can be fittingly connected respectively to tab (male) terminals 15 formed on a circuit provided at the fuse receiving portion 13. This fuse body 32 is formed into an integral construction, using a metal sheet.

Figure 2:
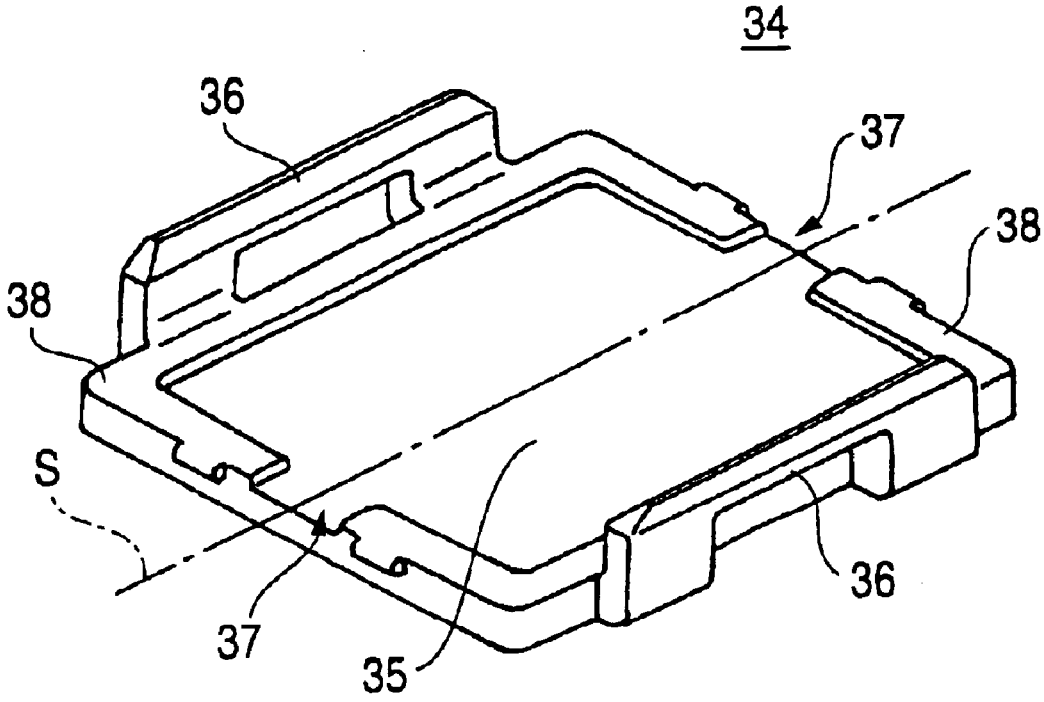
FIG. 2 is a perspective view of a cover of the fuse, showing an inner side thereof.

As shown in FIGS. 1 and 2, the cover 34 includes a lid 35 in the form of a generally rectangular plate, and a pair of locking pieces 36 extending downwardly respectively from opposite end edges of the lid 35, and this cover 34 is molded into an integral construction, using a transparent plastics material. The locking pieces 36 of the cover 34 are much shorter than the locking pieces 6 of the cover 4 shown in FIG. 6.

Retaining projections 46 are formed on and project respectively from upper portions of those side walls (peripheral wall) of the housing 3 corresponding respectively to the locking pieces 36. When the pair of locking pieces 36 are retainingly engaged with the retaining projections 46, respectively, the cover 34 is locked to the housing 33 in such a manner that this cover 34 covers the upper opening 45 in the housing 33.

As shown in FIG. 2, rigidity-reduced portions 37 are formed at an inner surface of the lid 35, and these rigidity-reduced portions 37 enable the lid 35 to be elastically deformed so that the locking pieces 36 can be displaced in disengaging directions relative to the retaining projections 46, respectively.

In this embodiment, the rigidity-reduced portions 37 are defined respectively by notch grooves formed by notching part of a reinforcing rib 38 formed on the inner surface of the lid 35 at a peripheral edge portion thereof.

Namely, two portions of the reinforcing ribs 38, disposed on a centerline S passing between the pair of locking pieces 36 on the lid 35, are notched to provide the notch grooves, respectively, and as a result the rigidity-reduced portions 37, which are lower in rigidity than those portions having the remaining reinforcing rib 38, are formed at the opposite end edge portions, respectively. Therefore, the lid 35 can be elastically deformed about the centerline S.

Figure 3B:
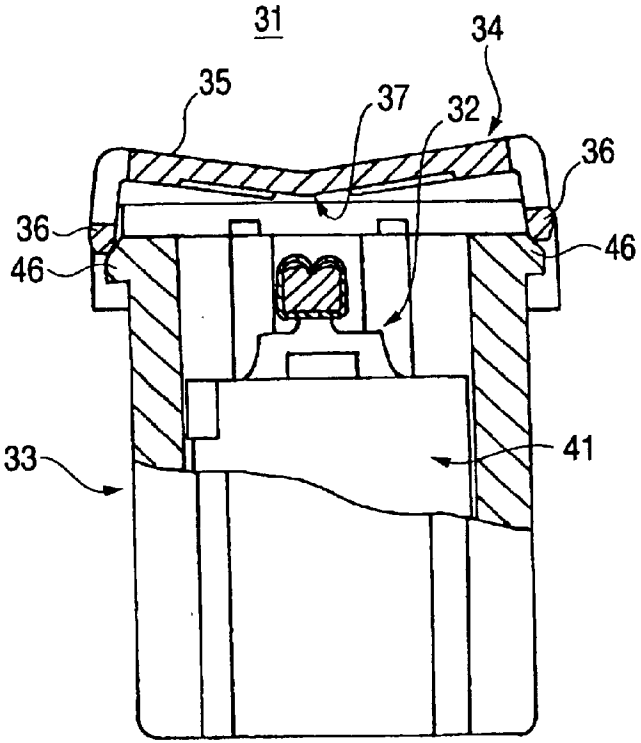
FIGS. 3A and 3B are partly cross-sectional, front views explanatory of a mounting operation of the cover on a housing.

Next, the procedure of assembling the fusible link 31 of this embodiment will be described with reference to FIGS. 3A and 3B.

Figure 3A:
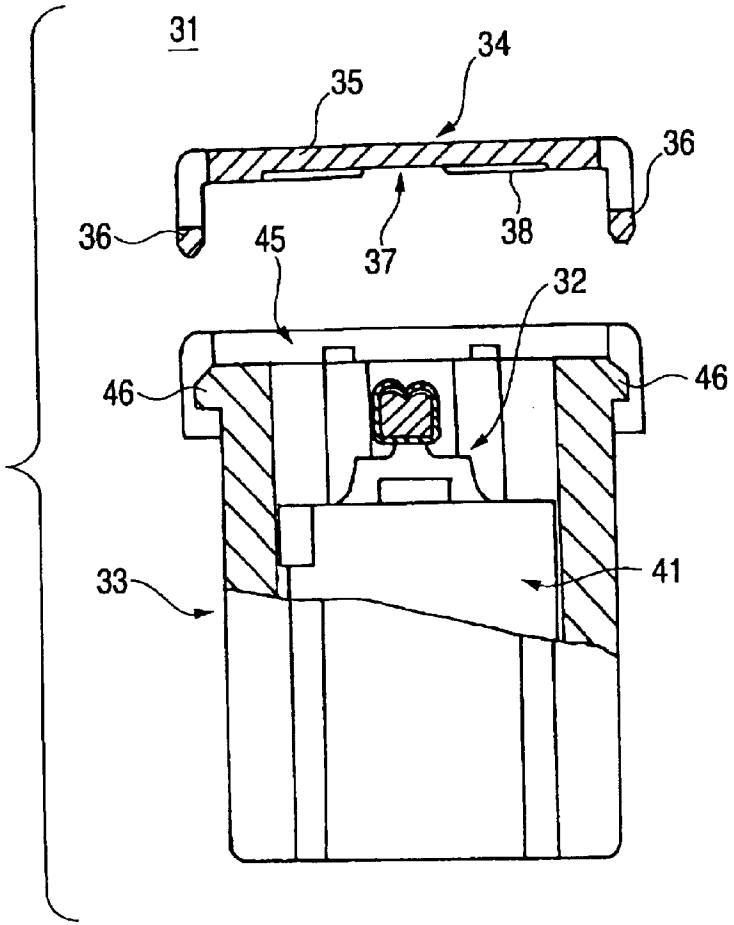

First, the fuse body 32 is inserted into the housing 33 through the upper opening 45, and is housed and held in this housing as shown in FIG. 3A.

Then, the cover 34 is put on the housing 33 to cover the upper opening 45, and the outer surface of the lid 35 is pressed, thereby bringing the locking pieces 36 into retaining engagement with the retaining projections 46, respectively.

At this time, the locking pieces 36 on the cover 34 are hardly elastically deformed in the disengaging directions relative to the retaining projections 46, respectively, since these locking pieces 36 are very short as described above. However, the lid 35 itself is elastically deformed at the rigidity-reduced portions 37 as shown in FIG. 3B, so that the locking pieces 36 can be displaced in the disengaging directions (left and right directions in this figure) respectively relative to the retaining projections 46 formed on and projecting from the peripheral wall of the housing 33.

Therefore, since an excessive force will not act on each locking piece 36 which is displaced so as to slide over the corresponding retaining projection 46, damage to the locking pieces 36 is prevented.

Accordingly, there can be obtained the compact fusible link provided with the cover 34 having the short locking pieces 36.

Figure 4:
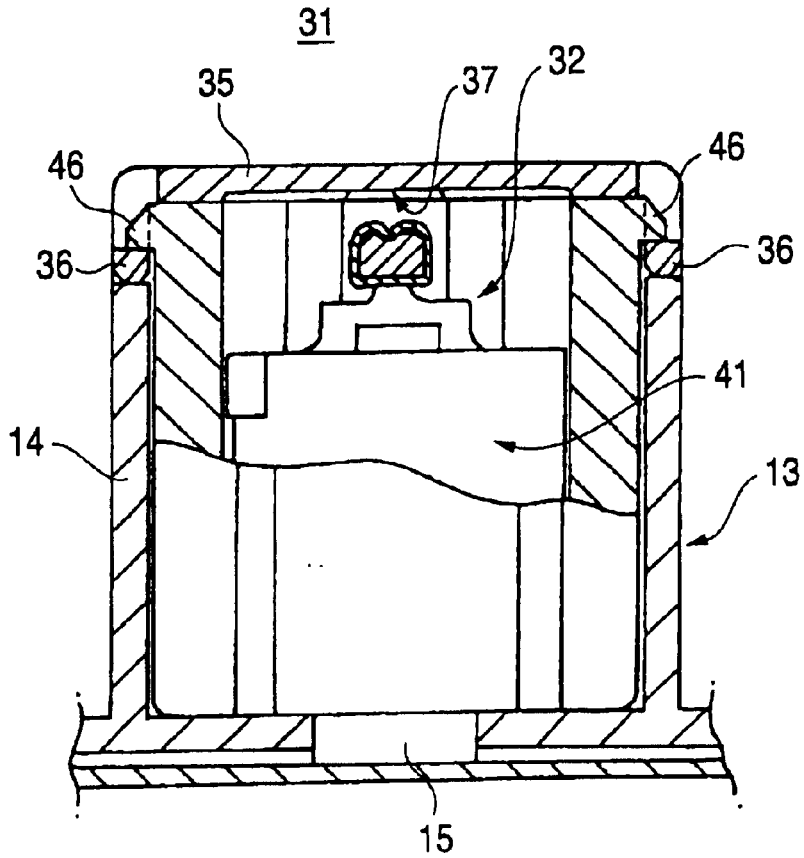
FIG. 4 is a partly cross-sectional view showing a condition in which the fuse is mounted in a fuse receiving portion.
Figure 7:
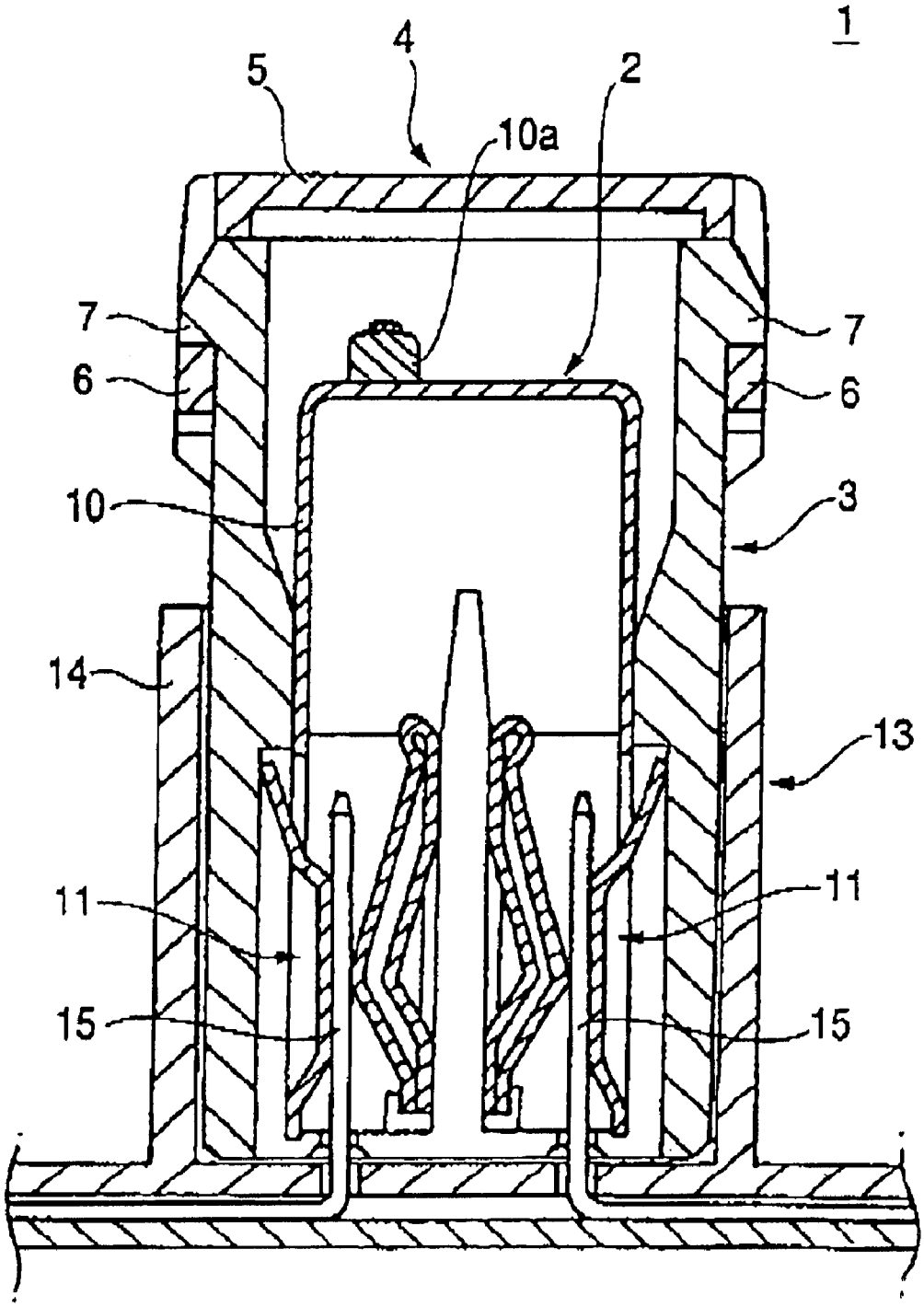
FIG. 7 RELATED ART
FIG. 7 is a partly cross-sectional view showing a condition in which the related-art fuse is mounted in a fuse receiving portion.
Figure 8:
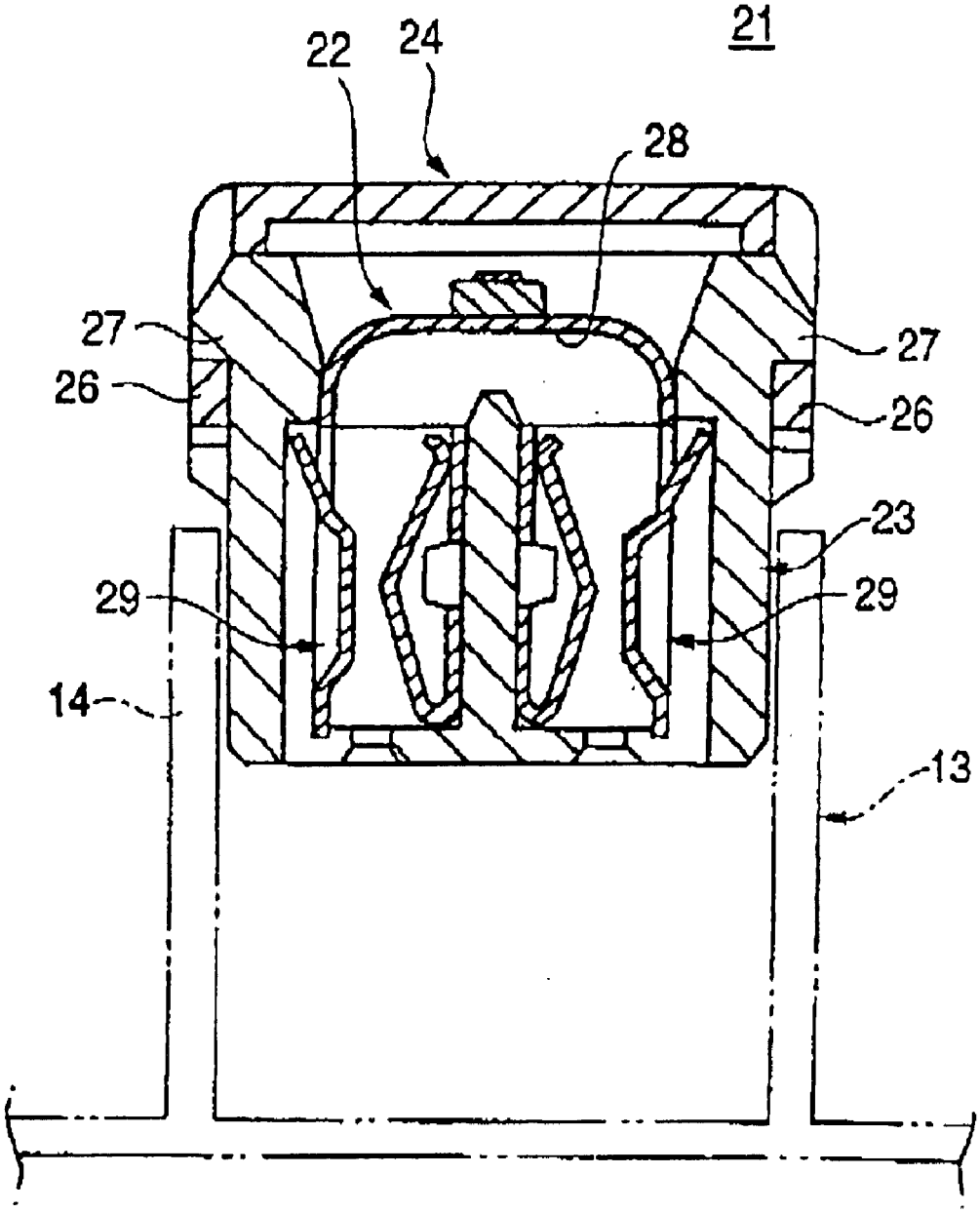
FIG. 8 RELATED ART
FIG. 8 is a cross-sectional view explanatory of problems encountered when the related-art fuse is formed into a compact design.

When the fusible link 31, having the short locking pieces 36, is mounted in a fuse receiving portion 13 (as same as that shown in FIGS. 7 and 8) formed at an electric connection box such as a relay box, the locking pieces 36 will not interfere with an upper edge of a fuse guide wall 14 as shown in FIG. 4, and this fusible link can be mounted in a proper position in the fuse receiving portion 13.

Therefore, it is not necessary to take countermeasures such as the reduction of the height of the fuse guide wall 14 and the formation of notches for preventing the interference, and a change of a mold for molding the electric connection box body and a complicated construction of the mold will not be incurred, so that the cost will not greatly increase.

Figure 6:
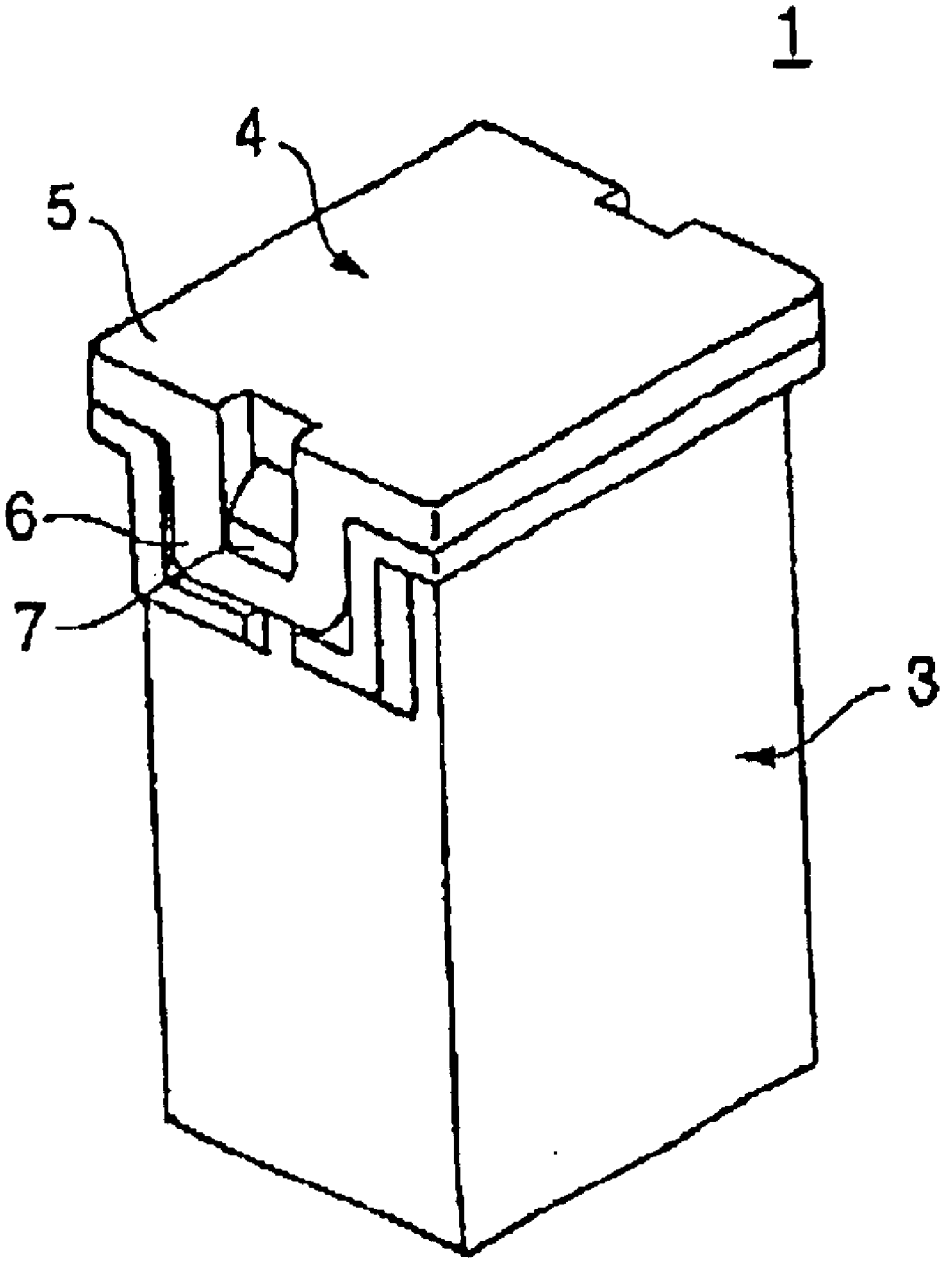
FIG. 6 RELATED ART
FIG. 6 is a perspective view of a related-art fuse.

Therefore, the fusible link 31 of this embodiment can be much more reduced in size and weight as compared with the related-art fusible link 1 shown in FIG. 6, and particularly as a result of the reduction of the height, a cover of the electric connection box can be reduced in height, so that the compact and lightweight design of the electric connection box can also be achieved.

The constructions of the fuse body, housing, cover, lid, locking pieces, rigidity-reduced portions, etc., of the fuse of the invention are not limited to the constructions of the above embodiment, but can take various constructions on the basis of the subject matter of the invention.

Figure 5:
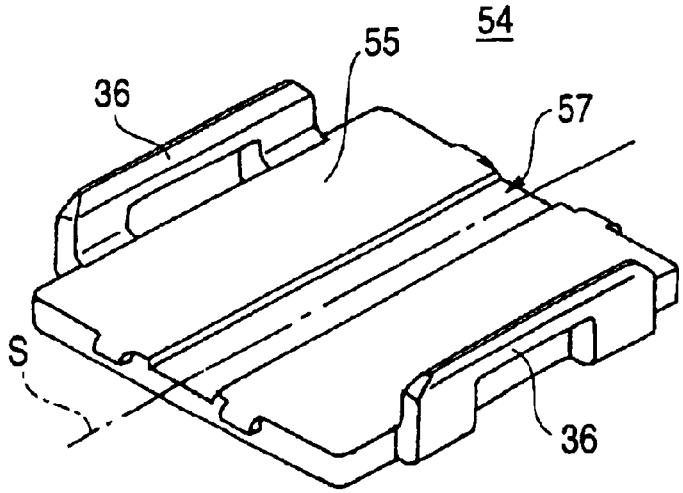
FIG. 5 is a perspective view of a cover of a fuse according to a second embodiment of the present invention.

For example, as second embodiment, a rigidity-reduced portion 57, provided at a cover 54 of FIG. 5, is defined by a notch groove formed in a generally-rectangular plate-like lid 55 and extending along a centerline S passing between a pair of locking pieces 36 on the lid 55. This lid can be elastically deformed about the centerline S. Of course, the cross-sectional shape of the notch groove and so on can take various shapes.

In the above embodiment, although the fuse body 32 of the fusible link 31 is of such a construction that the pair of female terminals 41 are formed integrally with the opposite ends of the fusible conductor 40, the fuse body may be of such a construction that so-called screw-fastening terminals are connected integrally to the opposite ends of the fusible conductor 40, respectively.

The fusible conductor may be of such a construction that it has a first melting portion and a second melting portion.

What is claimed is:

1. A fuse, comprising:

a fuse body, provided with a fusible element;

a housing body, containing the fuse body therein, and formed with an opening and a retaining projection arranged in the vicinity of the opening; and a cover body, formed with a locking piece adapted to engage with the retaining projection so that the cover body closes the opening, wherein a rigidity-reduced portion is formed in the cover body, so that the cover body can be flexed substantially without flexing the locking piece, at least when the locking piece engages with the retaining projection.

2. The fuse as set forth in claim 1, wherein the rigidity-reduced portion is a recessed portion formed in a face of the cover body to be opposed to the opening.

3. The fuse as set forth in claim 1, wherein the locking piece includes a pair of locking pieces, which are arranged symmetrically with respect to the rigidity-reduced portion.

4. The fuse as set forth in claim 1, wherein the fusible element is exposed through the opening, in a case where the cover body does not close the opening.

* * * * *